US006394385B1

(12) United States Patent
Rhodes et al.

(10) Patent No.: US 6,394,385 B1
(45) Date of Patent: May 28, 2002

(54) WINDING CORES FOR PRESSURE-SENSITIVE TAPE AND METHODS OF MAKING SAME

(75) Inventors: David W. Rhodes, Cornelius, NC (US); Krishnaraju Varadarajan, Florence; Richard K. Mims, Hartsville, both of SC (US)

(73) Assignee: Sonoco Development, Inc., Hartsville, SC (US)

( * ) Notice: Subject to any disclaimer, the term of this patent is extended or adjusted under 35 U.S.C. 154(b) by 51 days.

(21) Appl. No.: 09/589,421

(22) Filed: Jun. 7, 2000

(51) Int. Cl.[7] ..... B65H 75/14; B65H 75/18

(52) U.S. Cl. ..... 242/610.1; 242/610.1; 242/610.4; 156/187; 156/188; 156/195

(58) Field of Search ..... 242/610.1, 610.3, 242/610.4; 156/187, 195, 188

(56) References Cited

U.S. PATENT DOCUMENTS

| | | | |
|---|---|---|---|
| 1,156,193 | A | 10/1915 | Ward |
| 2,676,765 | A | 4/1954 | Kaplan |
| 3,115,246 | A | 12/1963 | Wicklund |
| 3,170,489 | A | 2/1965 | Cunningham |
| 3,448,774 | A | 6/1969 | Nelms |
| 4,950,518 | A | 8/1990 | Walliser |

FOREIGN PATENT DOCUMENTS

JP 404031035 A * 2/1992

* cited by examiner

*Primary Examiner*—Donald P. Walsh
*Assistant Examiner*—Jonathan R. Miller
(74) *Attorney, Agent, or Firm*—Alston & Bird LLP

(57) ABSTRACT

A tubular or ring-shaped core for winding pressure-sensitive tape has a paper board body and a release-coated outermost ply formed of a strip of polymer film having a release coating on its outer surface and a tacky adhesive layer on its inner surface. The strip is wound onto the core with one edge of the strip folded outwardly away from the core so as to expose the tacky adhesive layer on the folded edge. This folded edge is overlapped by the opposite edge of the strip, thereby placing the tacky adhesive layers on the two edges in contact with each other. A firm bond between the overlapping edges is achieved by the adhesive-to-adhesive contact. In a preferred embodiment, the overlapping edge of the strip overlaps slightly beyond the folded edge onto the unfolded outer surface of the strip. This unfolded portion is treated to promote adhesion of the overlapping edge thereto. Improved bonding of the polymer strip to the core, and improved conformance of the strip to irregularities in the core surface, are achieved in a preferred embodiment by heating the strip as it is being advanced to the core and applying tension to the heated strip to cause it to stretch as it is wound onto the core.

6 Claims, 2 Drawing Sheets

WINDING CORES FOR PRESSURE-SENSITIVE TAPE AND METHODS OF MAKING SAME

FIELD OF THE INVENTION

The invention relates to tubular cores onto which pressure-sensitive tape material is wound. The invention relates more particularly to such cores made of fibrous material such as paper board and to methods of making such cores, in which the cores are provided with an outermost layer of material that allows the tape material directly in contact with the core to be released cleanly from the core without being contaminated by fibers from the paper board body of the core.

BACKGROUND OF THE INVENTION

Pressure-sensitive tapes are commonly wound onto cores formed from paper board. When the tail end of the tape that is directly in contact with the paper surface of the core is peeled off the core, some of the paper fibers stick to the adhesive side of the tape, which renders the tail end unsuitable for use.

A number of techniques have been tried or proposed for eliminating this problem of contamination of the tail end of the tape. One approach has been to form the core with an outermost paper board ply whose outer surface is coated with a release material that allows the tape to be peeled off. With this method, it is difficult to assure that no uncoated paper will be exposed at the outer surface of the core. For example, if the release-coated ply is wound such that there is a gap between the juxtaposed opposite edges of the ply, then uncoated paper board of the underlying ply is exposed in this gap. The gap can potentially be eliminated by forming perfect butt joints between the juxtaposed edges of the ply, but in practice this is very difficult to do, particularly at high winding speeds. Thus, this is not a feasible solution to the problem.

One solution to the problem of the gap between the ply edges that has been attempted is to first wind a relatively narrow strip of material having a release surface onto the core at the same helical pitch that the outermost release-coated ply is to be wound, and then the outermost ply is wound onto the core such that the juxtaposed edges of the ply fall on the underlying narrow strip. This is a relatively complicated and expensive method.

Another way of eliminating the gap is to overlap the opposite edges of the release-coated outermost ply and bond the overlapping edges together with adhesive. The problem with this technique is that the release coating on the outer surface of the ply makes it difficult to achieve a firm bond between the overlapping edges of the ply. Additionally, the uncoated side edge of the overlapping ply is still exposed.

Another method that has been tried involves winding a non-paper film (e.g., cellophane, polypropylene, or the like) onto the paper core and adhering it to the core such that the outer surface of the core is completely covered by the film. The film edges can be overlapped to ensure that no paper fibers are exposed at the outer surface of the core. However, when the core is cut to desired lengths, the film overlap joint tends to delaminate, which can expose paper fibers at the cut end of the core.

SUMMARY OF THE INVENTION

The above needs are met and other advantages are achieved by the present invention, which provides cores and methods for making cores in which a release-coated outer ply is wound onto and adhered to the core so as to completely cover the fibrous plies of the core. The release-coated ply is wound with a special overlap joint that ensures a good bond between the overlapping edges of the ply. In one embodiment of the invention, the release-coated ply comprises a strip of polymer film having a release coating on its outer surface and a tacky adhesive layer on its inner surface. The strip is wound onto the core with one edge of the strip folded outwardly away from the core so as to expose the tacky adhesive layer on the folded edge. This folded edge is overlapped by the opposite edge of the strip, thereby placing the tacky adhesive layers on the two edges in contact with each other. A firm bond between the overlapping edges is achieved by the adhesive-to-adhesive contact. In a preferred embodiment, the overlapping edge of the strip overlaps slightly beyond the folded edge onto the unfolded outer surface of the strip. This unfolded portion is treated to promote adhesion of the overlapping edge thereto. For example, the release coating on this portion can be corona discharge treated to destroy the release coating. The polymer strip advantageously can be formed of polypropylene with a pressure-sensitive adhesive applied on one side and a silicone-based release coating or the like on the other side. This material has the advantages of being readily available and inexpensive.

Improved bonding of the polymer strip to the core, and improved conformance of the strip to irregularities in the core surface, are achieved in a preferred embodiment by heating the strip as it is being advanced to the core and applying tension to the heated strip to cause it to stretch as it is wound onto the core. It has been found that the strip, when so heated and stretched, conforms well to slightly rough core surfaces. This effect can be advantageous in that the resulting surface of the final core is not perfectly smooth, and hence there may be less contact area between the tape and the core so that the tape releases more easily from the core.

In an alternative embodiment of the invention, the outermost ply of the core is formed of a strip of fibrous material such as paper board, one side of which is coated with a polymer film. A release coating is applied over the side of the polymer film facing away from the paper board. The strip of coated paper board is wound onto the core with adhesive interposed therebetween. One edge of the strip is folded inwardly toward the core, and this folded edge overlaps the opposite unfolded edge of the strip, thereby placing the film on the folded edge in contact with the film on the opposite edge. The overlapping edges are bonded together. Preferably, the film on the strip is a heat-sealable material, and the edges are bonded together by heat sealing. Advantageously, the adhesive for bonding the strip to the core is applied to the inner surface of the strip before it is wound and before the edge of the strip is folded such that the adhesive bonds the folded edge onto the inner surface of the strip to prevent unfolding.

DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE DRAWINGS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
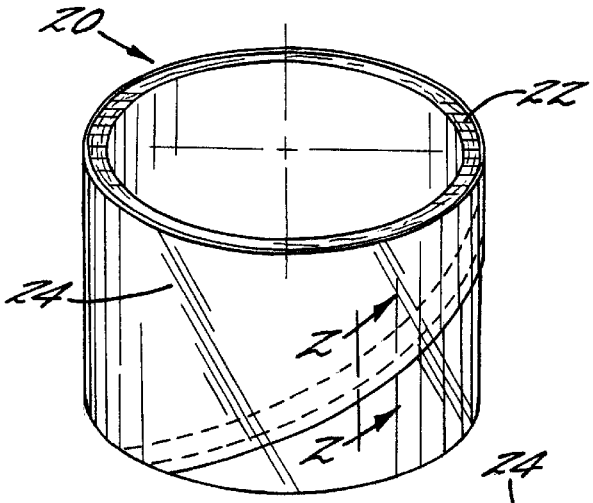
FIG. 1 is a perspective view of a core in accordance with a first embodiment of the invention.
Figure 2:
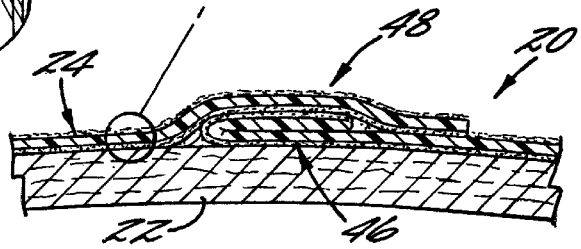
FIG. 2 is a cross-sectional view taken on line 2—2 of FIG. 1, showing the overlap joint construction.

With reference to FIGS. 1 through 4, a product and process in accordance with a first embodiment of the invention are depicted. FIG. 1 shows a winding core 20 for pressure-sensitive tape. The core 20 includes a tubular body wall 22 formed by plies of fibrous material such as paperboard. Wrapped about the outer surface of the body wall 22 is a release ply 24 for providing a surface from which the pressure-sensitive tape can readily release. In the embodiment of the invention shown in drawings, the core is formed by spiral winding of the body plies and release ply; it should be understood, however, that the invention is equally applicable to cores formed by other techniques such as convolute wrapping as known in the art. The release ply 24 is spirally wound such that one edge portion of the ply overlaps an opposite edge portion of the previous turn. FIG. 2 is a cross section of the core 20 in the region of the overlap joint of the release ply.

Figure 3:
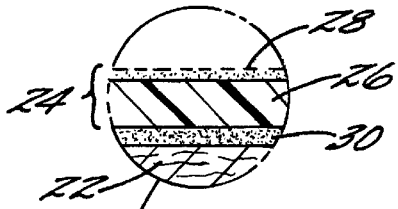
FIG. 3 is an enlarged view of the outer release ply of the core shown in FIGS. 1 and 2.

As shown in FIG. 2, the body wall 22 advantageously is formed of multiple plies of paperboard or other fibrous material spirally wrapped and adhered together. The release ply 24 is wound onto the outer surface of the body wall. As best seen in FIG. 3, the release ply 24 comprises a polymer film 26 having a coating of release material 28 on its outer surface and having an adhesive layer 30 on its inner surface. The polymer film 26 can be various polymers including polyolefins and polyesters; polypropylene has been satisfactorily used for this purpose. The release coating 28 can be any suitable material from which pressure-sensitive tape will readily release cleanly. Such release materials are well known; in particular, silicone-based release materials are suitable for this purpose, but other types of release coatings can be used. The adhesive 30 preferably is a pressure-sensitive adhesive material. The release ply 24 advantageously can be a known pressure-sensitive polymer tape often referred to as "box-sealing" tape because of its common usage in sealing cartons for shipment. The release ply 24 preferably has a thickness on the order of about 0.0015 inch and is formed of a polypropylene film 26 with a release coating 28 and a pressure-sensitive adhesive 30.

Figure 4:
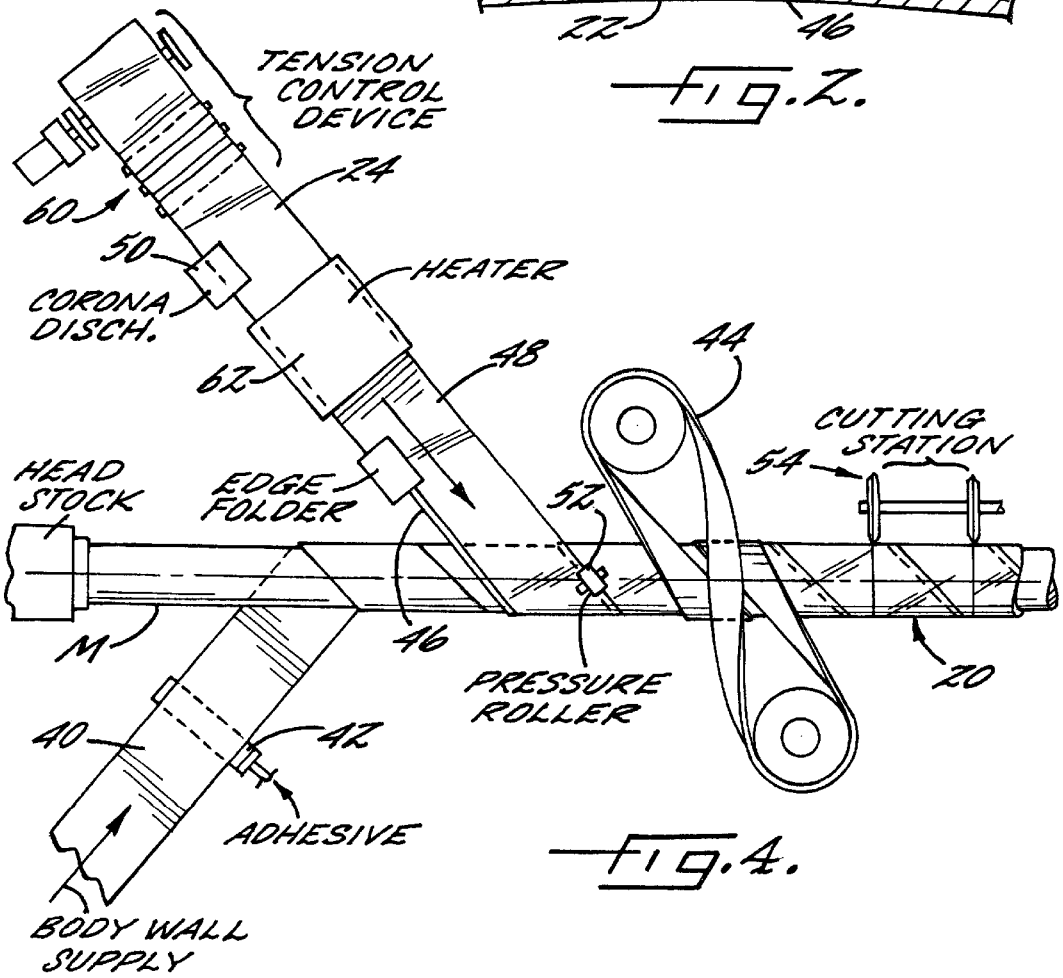
FIG. 4 is a diagrammatic elevational view of an apparatus and process for making cores as depicted in FIG. 1.

With reference to FIGS. 2 and 4, the core 20 in accordance with the first embodiment of the invention is formed by spiral winding the various plies onto a mandrel M of cylindrical form. The formation of a fibrous core body on such mandrels is well known and hence is not described in detail herein. Suffice it to say that a plurality of body plies 40 (only one shown in FIG. 4) are advanced from supplies thereof toward the mandrel M and are wrapped spirally at a predetermined spiral angle onto the mandrel one atop another, and adhesive is applied by a suitable adhesive applicator 42 to the surface of each body ply that will have another body ply wrapped onto it, thus forming a tube on the mandrel. A spiral winding belt 44 engages the tube on the mandrel and helically drives the tube along the mandrel. The belt 44 also serves to apply pressure to the tube to press the various plies together.

The outer release ply 24 is spirally wound onto the paperboard tube formed on the mandrel. The challenges in wrapping a release ply onto a paperboard tube are to wrap the release ply so that all surfaces of paperboard are covered by the release ply and yet achieve a secure connection of the release ply at all regions of the ply. To cover all surfaces of the paperboard, the release ply either must be wrapped with perfectly aligned butt joints or must be wrapped with an overlap joint. Because it is not realistic to expect that perfectly aligned butt joints can be achieved at all times, the logical choice is to use an overlap joint when wrapping the release ply 24. The difficulty with this approach, however, is achieving sufficient strength of the bond between the overlapping edge portions of the release ply.

In accordance with the first embodiment of the present invention, the requisite strength of the overlap joint can be achieved by forming the overlap joint in a particular manner as depicted in FIGS. 2 and 4. The release ply 24 is advanced from a supply to the mandrel M at a predetermined spiral angle. Before the release ply reaches the mandrel, the upstream edge portion 46 is folded outwardly (i.e., away from the mandrel) so that the pressure-sensitive adhesive layer 30 on the inner surface of the ply is facing outward. The spiral wind angle of the release ply is such that the opposite downstream edge portion 48 of the ply overlaps the outwardly folded edge portion 46, thus placing the adhesive layers 30 on the overlapping edge portions 46 and 48 in contact with each other.

Preferably, as shown in FIG. 2, the outer overlapping edge portion 48 extends beyond the folded edge portion 46 onto the unfolded portion of the release ply. To assure a good bond between the adhesive layer 30 on the edge portion 48 and the unfolded portion of the ply, the release coating 28 on this unfolded portion of the release ply is destroyed by passing the edge portion through a corona discharge treatment unit 50 or equivalent treatment unit (e.g., a flame treatment unit). The treatment unit 50 destroys the release coating only on the edge portion of the release ply that will be folded and on the unfolded portion that will be overlapped by the opposite edge portion of the ply. The release coating on the remainder of the outer surface of the release ply is left intact, since this surface will be in contact with the pressure-sensitive tape product that will be wound onto the core in use. The overlap joint preferably is pressed on the mandrel by a roller 52 so as to assure a firm bond between the overlapping edge portions of the release ply. The finished tube on the mandrel can be cut into predetermined lengths at a cutting station 54.

It is also preferred, although not essential, that the release ply 24 be heated and wound onto the mandrel at a controlled tension so that the release ply is slightly softened and undergoes a slight amount of elongation and width reduction. Thus, the release ply 24 is passed through a tension control device 60 for regulating the tension in the release ply, and is passed through or under a suitable heater 62 prior to reaching the mandrel. As an illustrative example, the release ply can be a 0.0015-inch thick and 4-inch wide box sealing tape formed of polypropylene with pressure-sensitive adhesive and a silicone release coating. The release ply is wound onto the mandrel with a tension of about 3 to 5 pounds per inch of width and is heated sufficiently to cause the width of the ply to be reduced by about ⅛-inch when it reaches the mandrel.

When heated and tensioned in this manner, the release ply tends to conform closely to irregularities in the outer surface of the paperboard body. Some paperboards have a naturally rough or undulating surface imparted by the felts or wires used in manufacturing the paperboard. This effect can be used to advantage by providing the paperboard body to have a rough surface, to which the release ply conforms. Accordingly, the surface of the release ply will also have a rough surface, and hence the amount of surface area of the release ply to which the pressure-sensitive tape product will adhere can be reduced, thus facilitating release of the tape product from the core.

In FIG. 4, the release ply 24 is shown being wound onto the paper board body tube at a location between the winding belt 44 and the point where the body plies 40 are wrapped onto the mandrel. Alternatively, the release ply can be wound onto the body tube downstream of the winding belt 44; this may be preferable in order to avoid wrinkling of the release ply by the pressure and friction caused by the winding belt.

Figure 5:
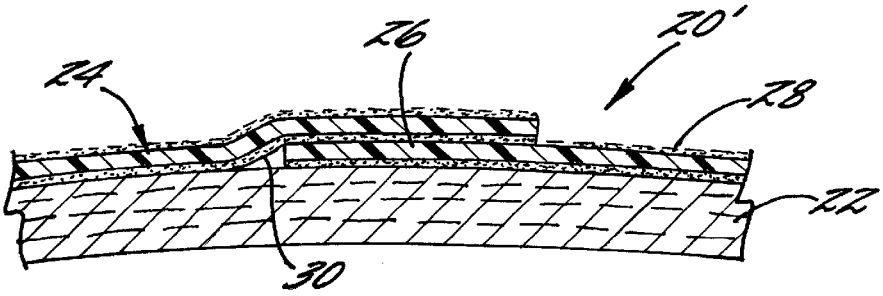
FIG. 5 is a cross-sectional view similar to FIG. 2, showing the overlap joint construction for a core in accordance with a second embodiment of the invention.

FIG. 5 depicts a winding core 20' in accordance with an alternative embodiment of the invention. The core 20' is in most respects similar to the core 20 described above, except that the edge of the release ply 24 is not folded. Instead, the adhesive layer 30 on the overlying edge is adhered to the polymer film layer 26 of the underlying edge portion, the release coating 28 on this underlying edge portion having been destroyed.

Figure 6:
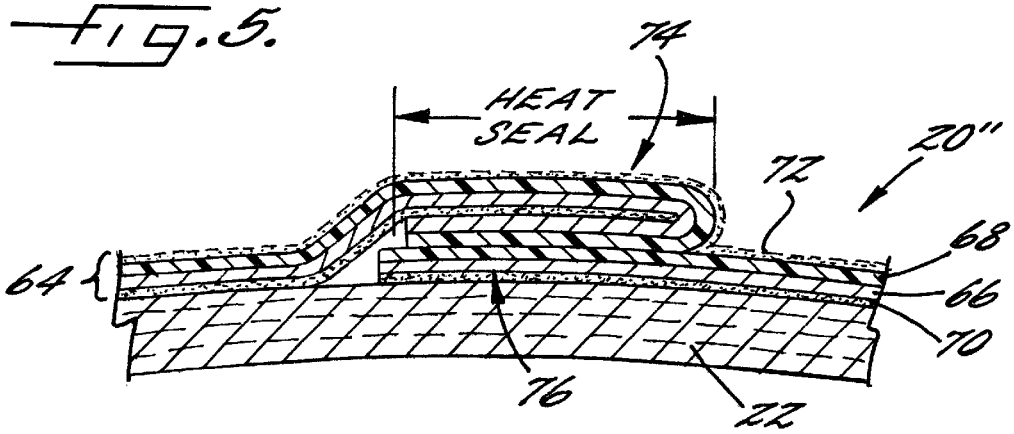
FIG. 6 is a cross-sectional view through the overlap joint of a core in accordance with a third embodiment of the invention.
Figure 7:
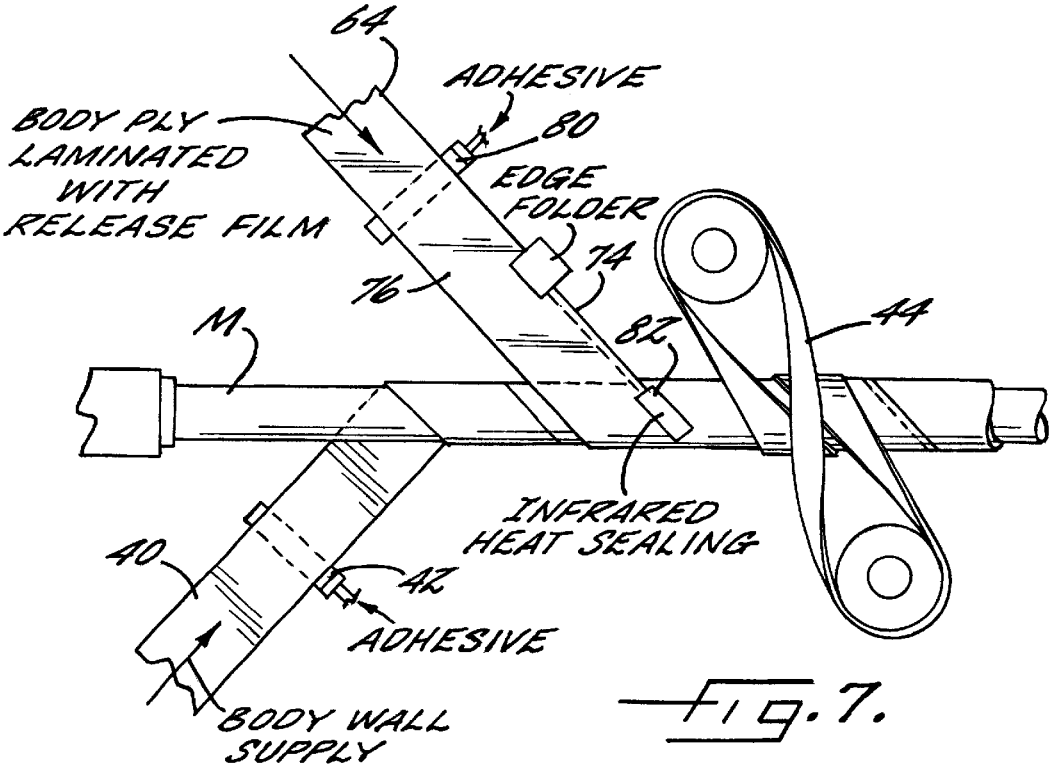
FIG. 7 is a diagrammatic elevational view of an apparatus and process for making cores as depicted in FIG. 6.

FIG. 6 depicts a winding core 20" in accordance with yet another embodiment of the invention, and FIG. 7 depicts an apparatus and process for making the core. The core 20" does not employ a polymer film release ply. Instead, the outermost ply 64 of the core 20" comprises a layer of paperboard 66 having a heat-sealable film layer 68 laminated to its outer surface. The film layer 68 can be extruded onto the paperboard layer 66. The ply 64 is adhered to the body wall 22 by an adhesive 70 in a manner similar to the other paperboard plies making up the body wall 22. The ply 64 has a release coating 72 covering the outer surface of the heat-sealable film layer 68. The outermost ply 64 is wound with an overlap joint that is then heat sealed. To this end, the overlying edge portion 74 is folded inwardly so that the heat-sealable layer 68 faces inwardly and contacts the heat-sealable layer 68 on the underlying edge portion 76. Prior to folding the edge portion 74, the adhesive layer 70 is applied to the inner surface of the ply 64 by a suitable adhesive applicator 80; accordingly, the folded edge is adhered to the inner surface of the ply 64. The overlap joint is heated on the mandrel by a suitable heater 82 such as an infrared heater or forced-air heater so as to cause the heat-sealable layers 68 on the edge portions to seal to each other. A pressure roller (not shown) can also be used on the overlap joint after the heater, if desired, similar to the process shown in FIG. 4.

Instead of heat sealing, the folded edge portion 74 alternatively can be adhered to the underlying unfolded edge portion 76 by a suitable adhesive applied between the edge portions. One difficulty with using a separately applied adhesive is preventing the adhesive from migrating out onto the outer surface of the core as the core is squeezed by the winding belt. Any adhesive on the outer surface of the core may tend to stick to the pressure-sensitive tape product wound on the core and prevent the tape product from easily releasing from the core. Careful control of the adhesive application may largely avoid this problem. When using separately applied adhesive rather than heat sealing, the release coating 72 on the outer surface of the outer ply 64 may interfere with the bonding of the edge portions. Accordingly, the release coating on the edge portions may have to be destroyed by corona discharge or flame treatment as previously described.

Although the outermost body ply 64 is shown being wound onto the paper board body tube upstream of the winding belt 44, it can alternatively be wound downstream of the belt.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A tubular core for winding a web of pressure-sensitive tape material thereon, the tubular core comprising:

one or more fibrous body plies wrapped about a longitudinal axis and adhered together so as to form a tubular body having an outer surface;

an outer release ply covering and adhered to the outer surface of the tubular body such that the release ply forms an outer surface of the core for wrapping the tape material thereon, the release ply being formed of a strip having an outer surface formed of a release material and having a tacky adhesive layer defining an inner surface of the strip, the strip being wrapped onto the tubular body with the tacky adhesive layer against the outer surface of the tubular body, a first edge portion of the strip being folded outwardly onto the outer surface of the strip such that the tacky adhesive layer on the first edge portion faces outwardly away from the tubular body, a subsequent wrap of the strip having an opposite second edge portion overlapping the outwardly folded first edge portion of an immediately preceding wrap of the strip such that the tacky adhesive layers on the two edge portions adhere to each other.

2. The tubular core of claim 1, wherein the second edge portion of the strip also overlaps an unfolded portion of the strip located adjacent the folded first edge portion such that the tacky adhesive layer on the second edge portion adheres to the outer surface of the unfolded portion of the strip.

3. The tubular core of claim 2, wherein the release material forming the outer surface of the strip, in the portion thereof that is overlapped by the second edge portion, is treated so as to promote adhesion of the tacky adhesive layer thereto, the release material on the remainder of the outer surface being untreated such that the pressure-sensitive tape wound onto the core is readily released therefrom.

4. The tubular core of claim 3, wherein the release material is corona discharge treated on the portion of the outer surface of the strip overlapped by the second edge portion.

5. The tubular core of claim 1, wherein the strip comprises a polymer film having a coating of the release material applied to one side thereof and having the tacky adhesive layer covering an opposite side thereof.

6. The tubular core of claim 5, wherein the strip is spirally wrapped about the body such that an overlap region between the first and second edge portions extends helically about the body.

* * * * *